US005735104A

United States Patent [19]

Odenthal

[11] Patent Number: 5,735,104

[45] **Date of Patent: *Apr. 7, 1998**

[54] METHOD OF PACKAGING GROUPS OF ARTICLES

[75] Inventor: Heinz F. Odenthal, Zülpich, Germany

[73] Assignee: Ostma Maschinenbau GmbH, Zulpich, Germany

[ * ] Notice: The portion of the term of this patent subsequent to Sep. 3, 2013, has been disclaimed.

[21] Appl. No.: 743,107

[22] Filed: Nov. 4, 1996

Related U.S. Application Data

[63] Continuation of Ser. No. 409,492, Mar. 23, 1995, abandoned.

[30] Foreign Application Priority Data

Apr. 1, 1994 [DE] Germany ..... 44 11 473.7

[51] Int. Cl.[6] ..... B65B 13/02

[52] U.S. Cl. ..... 53/399; 53/397

[58] Field of Search ..... 53/397, 399, 466, 53/582, 580, 586, 141, 389.3, 139.7, 136.2

[56] References Cited

U.S. PATENT DOCUMENTS

| | | | |
|---|---|---|---|
| 1,714,532 | 5/1929 | Walter | 53/587 |
| 4,534,151 | 8/1985 | Schneck et al. | 53/415 |
| 4,574,565 | 3/1986 | Gambetti | 53/466 |
| 4,671,043 | 6/1987 | Forni et al. | 53/399 |
| 4,905,451 | 3/1990 | Jaconell et al. | 53/587 |
| 5,168,685 | 12/1992 | Suzuki | 53/389.3 |
| 5,551,212 | 9/1996 | Odenthal | 53/399 |

FOREIGN PATENT DOCUMENTS

| | | |
|---|---|---|
| 0 313 721 | 5/1989 | European Pat. Off. . |
| 40 27 762 | 9/1991 | Germany . |

*Primary Examiner*—Linda Johnson
*Assistant Examiner*—John Paradiso
*Attorney, Agent, or Firm*—Herbert Dubno

[57] ABSTRACT

A web withdrawn from a coil is split to form tray-forming and head-encircling strips which are passed vertically across a path of a group of articles so that the strips are entrained by the group and pass under and over the group to be connected together at a rear portion into closed bands. The tray-forming band projects beyond the edges of the group and can be folded to form the tray. The feed conveyor advances the group of articles to the packaging station from which the group of articles is transferred to the discharge conveyor operating at a right angle to the feed conveyor.

9 Claims, 3 Drawing Sheets

METHOD OF PACKAGING GROUPS OF ARTICLES

CROSS REFERENCE TO RELATED APPLICATION

This is a file-wrapper continuation of application Ser. No. 08/409,492 filed 23 Mar. 1995, now abandoned.

SPECIFICATION

FIELD OF THE INVENTION

My present invention relates to a method of and to an apparatus for the application of a web of packaging material to a group of articles in tight formation and to an apparatus for carrying out this method. The term "group of articles" is intended to refer here to a stack or array of articles in side-by-side relationship which are to be bound together by the web to form a resulting package. The reference to "tight formation" is intended to signal that the spacing between the articles in the group is minimal and that the articles are in contact with one another or in contact with separating partitions or otherwise are sufficiently close together that the application of the bands will secure them in the package against involuntary dislocation, i.e. involuntary shifting or falling from the package.

The articles are generally identical, usually are in contact with one another and preferably are grouped in an array which is of rectangular parallelopipedal configuration, i.e. approximately cubic. The articles themselves can be of any shape enabling them to be grouped in this manner, e.g. cylindrically shaped or having a configuration of rectangular parallelopipeds, such as boxes or cartons of a product.

BACKGROUND OF THE INVENTION

In EP 0 313 721 A2, the application of band-like packaging material to a group of articles in tight formation is described in which the band-like packaging material is formed as packaging bars which are applied to the edges and corners of the group and assembled to form a support frame which can be utilized to handle, e.g. carry, the group of articles.

This system has been found to be satisfactory but requires the use of correspondingly stiff packaging materials which can fulfill the requirements of a reasonably stiff and self-supporting frame. Such materials are expensive and have been found to contribute, for example, in the case of stacks of rectangular parallelopipedal articles, 10 to 20 mm in height or width to the package. In many cases, this can interfere with storage and shipping of the packages. The tolerances in the stacks can be of a corresponding dimension and when the bars are dimensioned to accommodate the greatest tolerances, the articles may be held only loosely and in an unsatisfactory manner. In other words, there are conditions under which it is desirable to ensure tight packaging of the articles and these may not be satisfied with such relatively rigid bars or frame members.

In DE 40 27 762 C1 and the commonly assigned copending application Ser. No. 08/025,828 filed 3 Mar. 1993 as a division of now abandoned application Ser. No. 07/747,196 of 16 Aug. 1991, the wrapping of a strip around a group of articles as the strip is paid-out from a coil, has been described. In this case, the strip is held under tension as it is passed around the group of articles and thus the group of articles is tightly engaged in the band when the ends thereof are joined together around the group. In this case, the band is bent around the group of articles.

This system has been found to be satisfactory but requires the use of correspondingly stiff packaging material which can fulfill the requirements of a reasonably stiff and self-supporting frame. Such materials are expensive and have been found to contribute, for example, in the case of stacks of rectangular parallelopipedal articles, to undesirable increases in height or width to the package. In many cases, this can interfere with storage and shipping of the packages. The tolerances in the stacks can be 10 to 20 mm, and when the bars are dimensioned to accommodate the greatest tolerances, the articles may be held only loosely and in an unsatisfactory manner. In other words there are conditions under which it is desirable to ensure tight packaging of the articles and these may not be satisfied with such relatively rigid bars or frame members.

In DE 40 27 762 C1 and the commonly assigned copending application Ser. No. 08/025,828 filed 3 Mar. 1993 as a continuation of now abandoned application Ser. No. 07/747,196 of 16 Aug. 1991 (now U.S. Pat. No. 5,551,212), the wrapping of a strip around a group of articles as the strip is paid-out from a coil, has been described. In this case, the strip is held under tension as it is passed around the group of articles and thus the group of articles is tightly engaged in the band when the ends thereof are joined together around the group. In this case, the band is bent around the group of articles. This allows tight packaging of a group without the aforementioned tolerance problems, utilizing a less stiff packaging material, which can be, for example, so-called Kraft paper. This system also permits the packaging material to have an edge which projects beyond the stack at either the upper or lower side and to be bent over the stack.

OBJECTS OF THE INVENTION

It is the principal object of the present invention to provide an improved method of packaging groups of articles in tight formation whereby drawbacks of earlier systems are avoided, and, in particular, the group of articles can be wrapped in an especially simple manner with a strip of packaging material which is withdrawn from a coil and applied to the stack.

Another object of the invention is to provide an especially simple and effective system for wrapping a group of articles with a web of thin flexible material.

SUMMARY OF THE INVENTION

These objects and others which will become apparent hereinafter are attained, in accordance with the invention, by a method of packaging a group of articles in tight formation, usually cylindrical articles or parallelopipedal articles in side-by-side contact in which the group of articles is advanced on a feed conveyer to a packaging station. The packaging material is withdrawn as a web from a coil and, upon being withdrawn from the web, is split into two strips, namely, a tray-forming strip and a head-encircling strip.

The group of articles can have a lower portion which is to be received in a tray and an upper portion close to the heads of the article to be engaged by the head-encircling strip and the group of articles is preferably advanced as described on a side so that the bottom portion and the top portion are spaced apart side to side rather than top to bottom.

According to the invention, after splitting of the web into the two strips, a length of each of the strips is payed out, corresponding to the length of the group and the strips are extended vertically across the packaging station with a spacing which is determined by the height of the package to be formed so that the tray-forming strip is generally aligned with the bottom portion of the group and the head-encircling strip is generally aligned with the upper portion of the group.

The group is then advanced past the vertical stretches onto a discharge conveyor, thereby extending the stretches of the strips dangling below the path of the group of articles onto the discharge conveyor while the strips are fed to also overlie the group of articles, thereby wrapping the strips around the group and allowing ends of the strips to extend beyond the rear side of the group, i.e. the trailing side thereof. These ends of the two strips are respectively secured together so that each loop is closed to encircle the group, whereupon portions of the tray-forming strip which extend beyond an edge of the group are folded inwardly to transform the band of the tray-forming strip encircling the group into a tray. This portion of the tray-forming strip may be folded over the bottom of the stack and can constitute a tray edge or a tray bottom. The folded portion is fixed in position. According to the invention, moreover, the formation of the strips has loops around the group, the fusing together or adhesive bonding of the ends of the strips and the folding of the tray-forming strip over the bottom of the group or stack can all be carried out on the discharge conveyer.

The method of the invention thus comprises:

(a) advancing a group of articles in a tight formation on a feed conveyor to a packaging station;

(b) drawing a web of a flexible packaging material from a coil thereof and splitting the web into a tray-forming strip and a head-encircling strip and supplying the strips to the packaging station;

(c) extending the strips in a spaced-apart relationship vertically across a path of the group and with a spacing determined by a height of the group, the tray-forming strip being disposed in a region of a bottom portion of the group and the head-encircling strip being disposed in a region of a head portion of the group;

(d) displacing the group along the path from the feed conveyor onto a discharge conveyor so that a leading side of the group engages the strips extending vertically along the path, while feeding the strips so that the group draws the strips onto the discharge conveyor under the group and the strips are drawn over the group in generally U-shaped loops around the group, and ends of the strips extend beyond a trailing side of the group on the discharge conveyor;

(e) fastening ends of the strips together along the trailing side of the group, thereby tightly securing the articles of the group together with a head-encircling band formed by the head-encircling strip and with a bottom band formed by the tray-forming strip on the discharge conveyor; and (f) folding the bottom band to form a tray therefrom with a tray rim and a tray bottom on the discharge conveyor.

According to the invention, both the tray-forming strip and the head-encircling strip are applied around the group of articles under tension to form taut bands therearound and press the articles together.

According to a further feature of the invention, both the feed conveyor and the discharge conveyor can be continuously moved during the steps of the method. Alternatively cyclical or periodic displacement can be imparted to the conveyor.

While I have indicated that the web can be split to form the tray-forming strip and a head-encircling strip, it should be understood that the splitting of the web can yield additional strips which can encircle the group of articles as well, e.g. at least one intermediate strip between the head encircling strip and the tray-forming strip. An Additional tray-forming strip or the tray-forming strip may be applied at a head portion of the group if desired and, if desired, the strips may be provided with reinforcing folds or with additional reinforcements as may be required.

The invention thus allows a comparatively thin, flexible web of packaging material to be withdrawn from a coil and applied around the groups of articles in tight formation in a comparatively simple and economical manner and in a comparatively brief packaging time while also allowing the packaging station to accommodate any tools which may be necessary for the process. As a result, the apparatus for carrying out the process can be comparatively simple.

In particular, the apparatus for practicing the invention can comprise:

a feed conveyor for advancing a group of articles in a tight formation to a packaging station;

means for drawing a web of a flexible packaging material from a coil thereof, for splitting the web into a tray-forming strip and a head-encircling strip, and for supplying the strips to the packaging station;

guide means for extending the strips in a spaced-apart relationship vertically across a path of the group and with a spacing determined by a height of the group so that the tray-forming strip is disposed in a region of a bottom portion of the group, and the head-encircling strip is disposed in a region of a head portion of the group;

a discharge conveyor at substantially a right angle to the feed conveyor and positioned so that a leading side of the group engages the strips extending vertically along the path while the strips are fed so that the group draws the strips onto the discharge conveyor under the group and the strips are drawn over the group in generally U-shaped loops around the groups and whereby ends of the strips extend beyond a trailing side of the group on the discharge conveyor;

means for sealing ends of the strips together along the trailing side of the group, thereby securing the articles of the group together with a head-encircling band formed by the head-encircling strip and with a bottom band formed by the tray-forming strip on the discharge conveyor; and means for folding the bottom band to form a tray therefrom with a tray rim and a tray bottom on the discharge conveyor.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
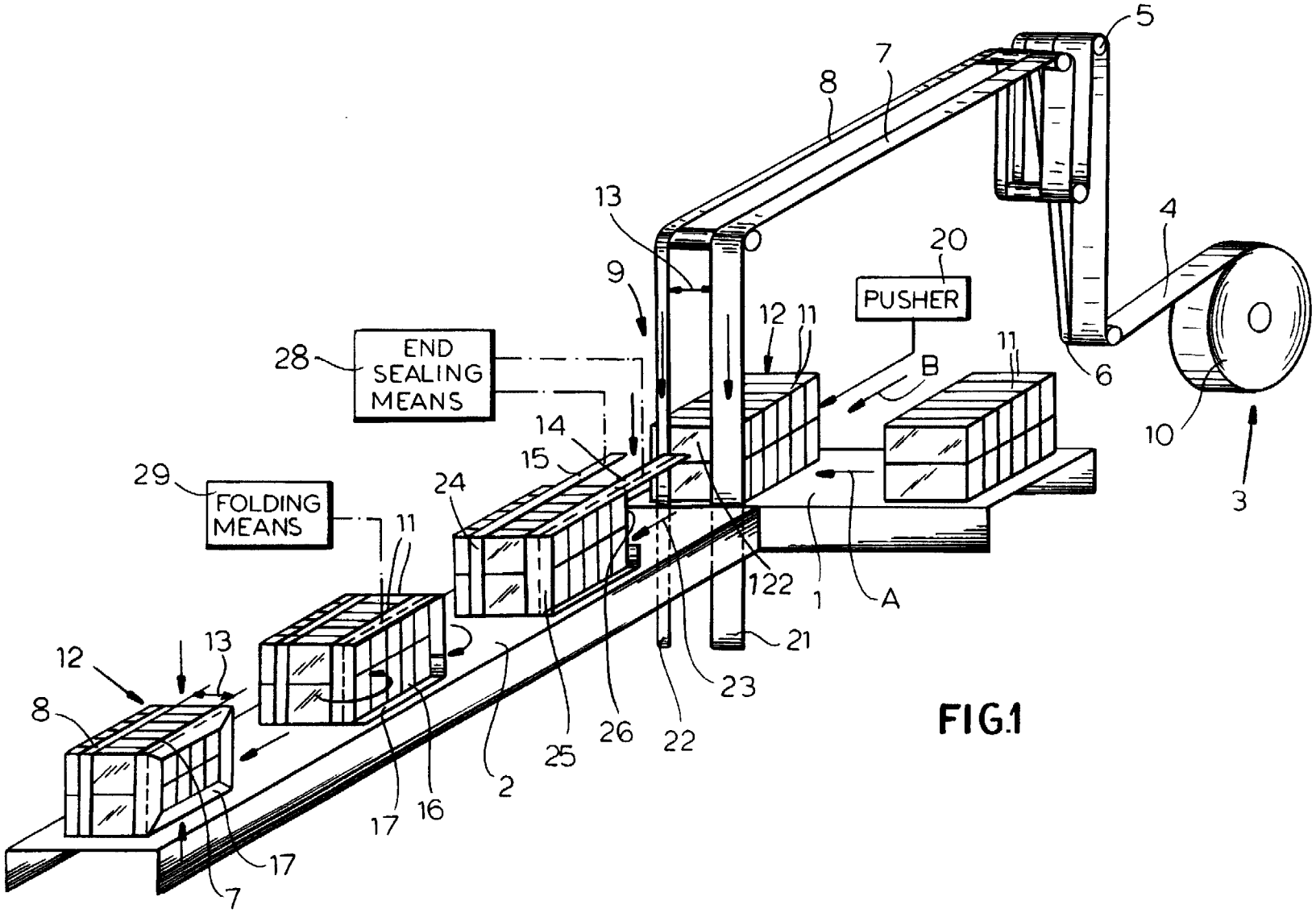
FIG. 1 is a perspective view in highly diagrammatic form illustrating an apparatus for carrying out the method of the invention.
Figure 2:
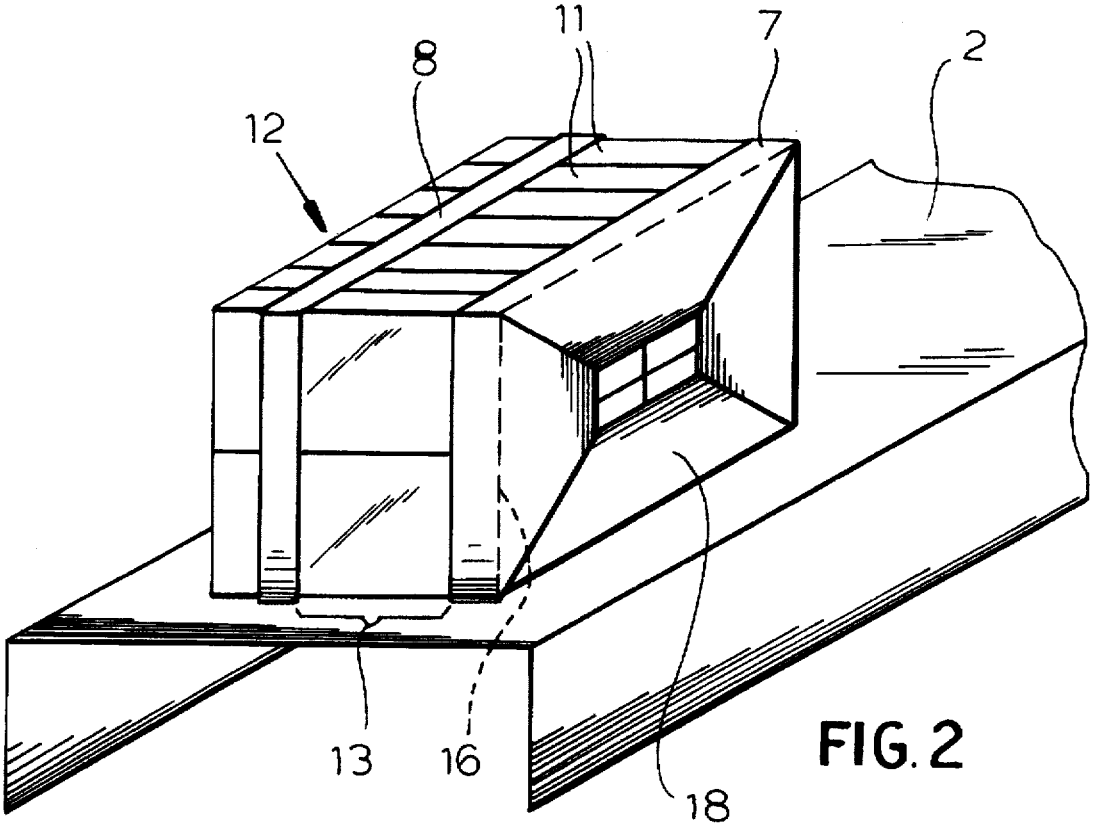
FIG. 2 is a perspective view showing to a larger scale a portion of the process represented in FIG. 1.
Figure 3:
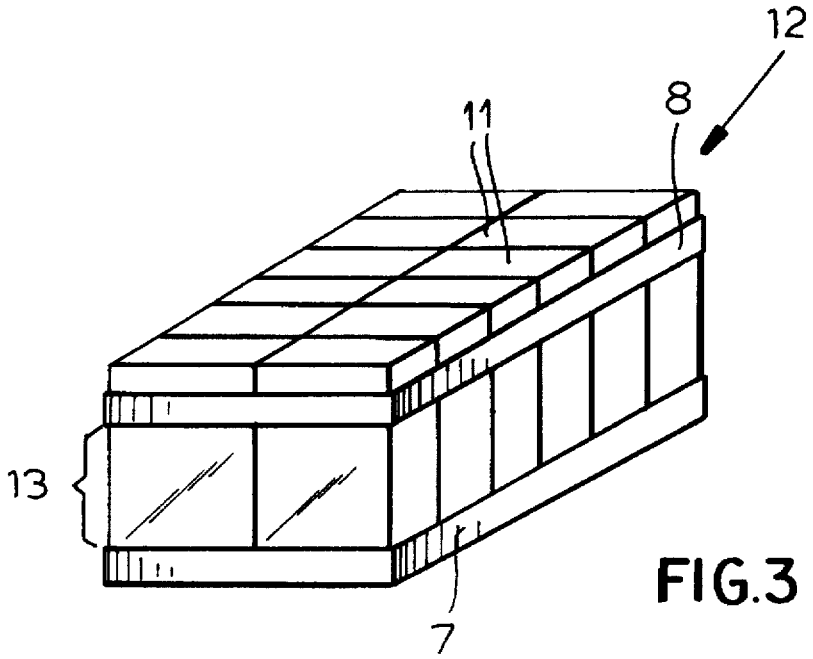
FIG. 3 is a perspective view of the resulting package.

The apparatus shown in FIGS. 1 and 2 comprises a feed conveyor 1 which extends at a right angle to a discharge conveyor 2 and displaces a stack of rectangular parallelopipedal articles 11, e.g. boxes, in the direction of arrow A to a packaging station 9 from which each group 12 of the articles can be displaced by a pusher 20 in the direction of arrow B onto the discharge conveyor.

Above the level of the feed conveyor 1 and the discharge conveyor 2, a coil unwinder 3 is provided and serves to feed a web 4 of the packaging material from a coil 10 to the packaging station. The coil unwinder can include web withdrawal rollers 5 and a spacer device 6 for subdividing the web 4 of the material into a tray-forming strip 7 and a head-encircling strip 8. It can be seen that the tray-forming strip 7 and the head-encircling strip 8 are provided in a vertical pattern across the path of the group 12 which is fed from the feed conveyor 1 to the discharge conveyor 2. Below the group 12, portions 21 and 22 of the two strips dangle, the dangling portion being of a length sufficient to enable the strips to fully underlie the group 12. The packaging stations can be provided with tools for folding the strips and for connecting the ends of the strips as will be described.

The apparatus thus places the vertical stretches of the strips ahead of the upstream end 122 of the group of articles, whereby the strips are entrained by the group as the group is diplaced by the pusher onto the conveyor 2 and then is carried by the conveyor 2 as shown at 23 away from the conveyor 1. The result is U-shaped loops 24 and 25 of the head-encircling strip and the tray-forming strip, respectively around the stack. The loops have extremities 14, 15 which lie along the rear face 26 of the group of articles. The ends 14 and 15 of the strips are joined to the trailing edges of the tray-forming strip and the head-encircling strip, respectively, to transform the strips into endless bands within which the articles are tightly held.

As is also apparent from FIGS. 1 and 2, a rim 16 of the packaged batch of articles 12 projects beyond the batch and can be folded inwardly so that this edge 16 is transformed into a tray edge 17. The steps of application of the strips around the stack of articles, the attachment of the ends of the U-shaped loops together and the folding of the projecting portion of the strip to form the tray all are carried out on the discharge conveyor 2.

The conveyors can be driven continuously or periodically and, if the strips are held taut, these strips can be wound tightly around the articles. As is apparent from FIG. 1, the means for bringing the strip ends together and bonding them to one another has been represented at 28 while the means for folding inwardly the projecting edges of the tray-forming strip to form the tray has been shown at 29.

The gap between the strips 7 and 8 and represented at 13 is determined by the height of the package.

Figure 4D:
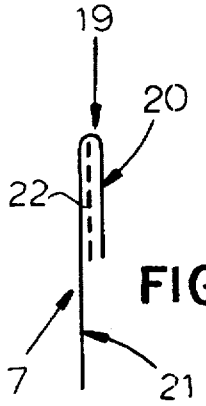
FIGS. 4*d*, 4*e* and 4*f* are cross sectional views through the strips of FIGS. 4*a*–4*c*.
Figure 4A:
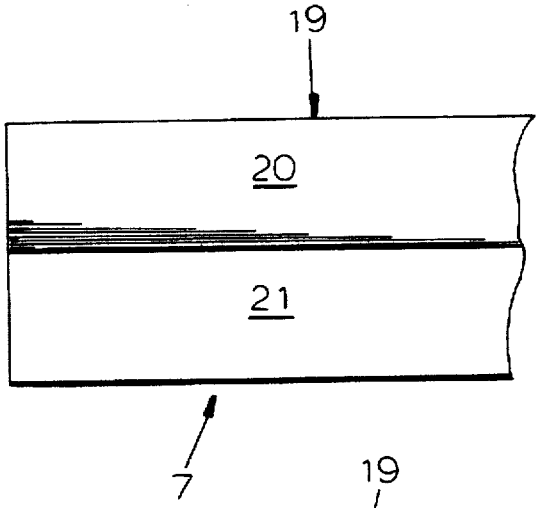
FIG. 4*a*, 4*b* and 4*c* shows different configurations of the head-encircling and tray-forming strips in accordance with the invention.
Figure 4E:
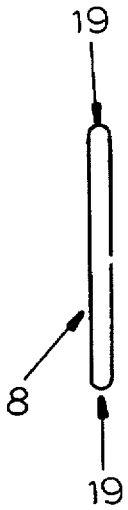
Figure 4B:
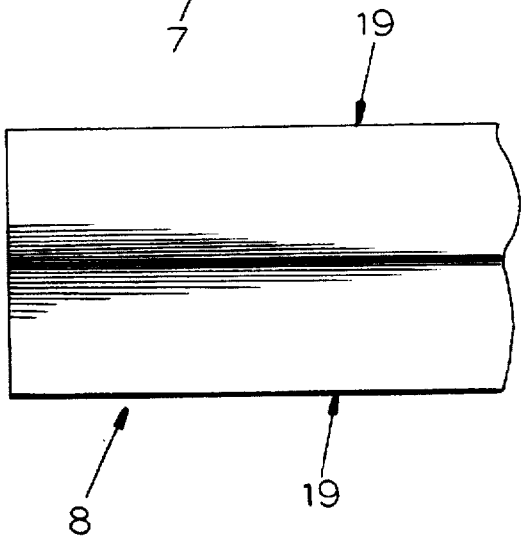
Figure 4F:
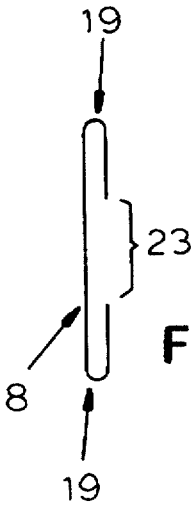
Figure 4C:
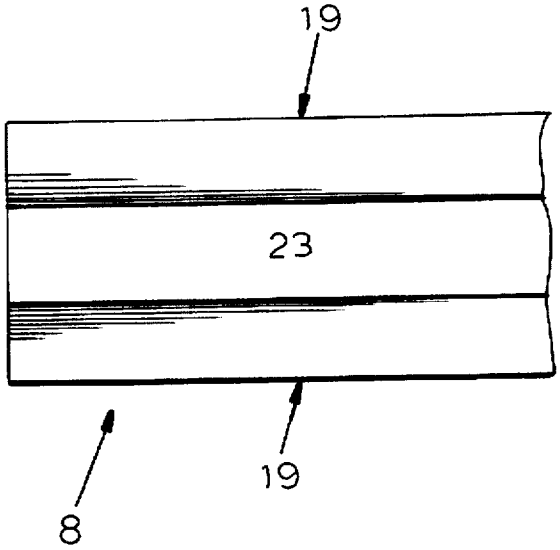

As can be seen from FIGS. 4*a*, 4*b* and 4*c* (and corresponding FIGS. 4*d*, 4*e* and 4*f*), the strips 7 and 8 can be provided with longitudinal folds and can be folded to form doubled-over strip regions at, for example, 20, to provide a doubled region which can lie along the side walls of the articles 11 and of the group 12. The folded region can be connected to a single layer region 21 which can form the tray edge 17 or the tray bottom 18. The parts of the doubled-over region of the tray-forming strip 7 can be glued together as has been indicated by a broken line with the reference numeral 22.

In FIGS. 4*b* and 4*c*, in the head-encircling region 8, the strip has two layers folded over one another about the longitudinal fold line 19, the folded-over regions being braced against one another as can be seen in FIG. 4*b* or being spaced apart as shown in FIG. 4*c* by a distance 23. The head-encircling strip 8 need not be arranged on the upper part of the rim of the unit 12. It can, for example, be disposed at an intermediate region of the height of the group of articles 11 to be packed.

I claim:

1. A method of producing a tray-packaging for a group of articles, the method comprising the steps of:

a) advancing the group of articles in a tight formation on a feed conveyor to a packaging station with the articles lying on their sides and bottoms of the articles oriented generally vertically;

b) drawing a web of a flexible and substantially inextensible packaging material from a coil thereof and splitting said web into a tray-forming strip and a head-encircling strip and supplying both said strips simultaneously to said packaging station;

c) extending said strips in the station in a spaced-apart relationship vertically across a path of said group of articles and with a spacing determined by a height of said group and with free ends hanging down, said tray-forming strip being disposed in a region of the bottoms of the group of articles and said head-encircling strip being disposed in a region of a head portion of said group of articles, said tray-forming strip extending horizontally past the bottoms of said group of articles, both said strips dangling across said path of the group of articles;

d) displacing said group along said path from said feed conveyor onto a discharge conveyor so that a leading side of said group of articles engages the strips dangling across said path, while feeding said strips so that said group of articles draws said strips onto said discharge conveyor under said group of articles and said strips are drawn over said group of articles in generally U-shaped loops around said group of articles, and ends of said strips extend beyond a trailing side of said group of articles on said discharge conveyor;

e) adhesively bonding the ends of said strips together along said trailing side of the group of articles, thereby securing said articles of said group tightly together with a head-encircling band formed by said head-encircling strip and with a bottom band formed by said tray-forming strip on said discharge conveyor, said bottom band having a portion extending beyond said bottom edge;

f) folding said portion of the bottom band against the bottoms of the articles to form a tray with a tray rim and a tray bottom formed by said portion of said bottom band on said discharge conveyor; and g) imparting a longitudinal fold to said tray-forming strip prior to feeding same to said packaging station, thereby forming a folded region which is applied to the side walls of the group of articles and an unfolded region which projects beyond an edge of the group, said unfolded region being thereupon folded in step f to form said tray.

2. The method defined in claim 1 wherein the feed conveyor and the discharge conveyor are continuously moved.

3. The method defined in claim 1 wherein the feed conveyor and the discharge conveyor are moved periodically.

4. The method defined in claim 1 wherein said head-encircling strip is provided with a longitudinal fold prior to feeding same to the packaging station and is doubled over upon application to said group of articles along said longitudinal fold of said head-encircling strip.

5. A method of packaging a group of articles having sides and bottoms, the method comprising the steps of:

drawing a web of a flexible and substantially inextensible packaging material from a coil and splitting the web into a tray-forming strip and a head-encircling strip;

forming a longitudinal fold in the tray-forming strip and thereby subdividing it transversely into a longitudinally extending inner portion and a longitudinally extending outer portion;

extending the strips in a station in a horizontally spaced relationship vertically across a conveyor path at a horizontal spacing determined by a height of the group and with free ends of the strips hanging down past a conveyor surface;

moving the group of articles in a tight formation on their sides with their bottoms oriented generally vertically on the surface along the path such that the tray-forming strip engages the sides of the articles at the bottoms with the outer portion extending horizontally past the bottoms and such that each strip is formed by the moving group into a U-shaped loop having trailing ends projecting back past a trailing end of the group of articles;

adhesively bonding the trailing ends of the head-encircling strip and of the tray-forming strip together against the trailing side and thereby securing the articles of the group tightly together with a head-encircling band formed by the head-encircling strip and a bottom band formed by the inner portion of the tray-forming strip; and folding the outer portion of the bottom band along the fold against the bottoms of the articles to form a tray from the tray-forming strip.

6. The packaging method defined in claim 5 wherein the articles are moved continuously through the station.

7. The packaging method defined in claim 5 wherein the articles are moved in steps through the station.

8. The packaging method defined in claim 5, further comprising the step of folding over and doubling the inner portion of the tray-forming strip prior to feeding it to the station.

9. The packaging method defined in claim 5 wherein the web is made of paper.

* * * * *